United States Patent [19]

Crisefi

[11] 4,207,851

[45] Jun. 17, 1980

[54] EMERGENCY IGNITION FOR INTERNAL COMBUSTION ENGINES

[76] Inventor: Charles J. Crisefi, 11502 59th Ter. North, Seminole, Fla. 33542

[21] Appl. No.: 899,739

[22] Filed: Apr. 25, 1978

[51] Int. Cl.[2] ..... F02P 1/00

[52] U.S. Cl. ..... 123/148 DS; 123/148 E

[58] Field of Search ..... 123/148 DS, 179 BG, 123/148 E, 148 DC

[56] References Cited

U.S. PATENT DOCUMENTS

| | | | |
|---|---|---|---|
| 2,152,650 | 4/1939 | Kilborn | 123/148 DS |
| 2,412,540 | 12/1946 | Sellaro | 123/148 DS |
| 2,548,056 | 4/1951 | Powasnick | 123/148 DC X |
| 3,168,891 | 2/1965 | Cook | 123/148 DS |
| 3,357,418 | 12/1967 | Goodman | 123/148 DS X |
| 3,408,536 | 10/1968 | Tibbs | 123/148 E X |
| 3,452,731 | 7/1969 | Becker | 123/148 DS |
| 3,718,124 | 2/1973 | Burley | 123/148 E X |
| 4,000,729 | 1/1977 | Clark, Jr. | 123/148 DS |
| 4,122,815 | 10/1978 | Gerry | 123/148 CC X |

*Primary Examiner*—Tony Argenbright

*Attorney, Agent, or Firm*—Walter J. Monacelli

[57] ABSTRACT

A portable emergency ignition unit which will enable a person to get a vehicle to a service shop when the electronic ignition, or the points, condenser or coil has failed, or when the ignition key has been broken or lost. This portable ignition unit has solid state integrated circuit and transistor which give the unit a more reliable and hotter spark. The circuitry comprises a simple hookup of one lead wire going to the ground terminal of the battery, another lead wire going to the positive terminal, a third lead wire going to the starter solenoid and lead wires going to the distributor. To start the engine, the starter button on the emergency unit is depressed so that 60,000 volts is applied by the ignition unit to the rotor inside the distributor cap, which voltage the rotor will distribute to the spark plugs in firing order sequence. Then when the starter button is released, a voltage of 30,000 volts is continued to the rotor and thereby to the spark plugs. This enables the engine to run at normal engine speed to enable the vehicle to be driven to a repair shop or for whatever emergency need is required.

6 Claims, 5 Drawing Figures

A
B

EMERGENCY IGNITION FOR INTERNAL COMBUSTION ENGINES

BACKGROUND OF THE INVENTION

1. Field of the Invention

This invention relates to a portable emergency ignition device capable of starting and running an internal combustion engine, such as an automobile or boat, when the engine is inoperative. More specifically, it relates to such a unit capable of applying 60,000 volts initially to start the engine and then maintaining a voltage of 30,000 volts to keep the engine running.

2. State of the Prior Art

A number of prior art patents have described devices to serve the function of starting internal combustion engines which have been incapacitated for one reason or another. Such U.S. Pat. Nos. include 1,765,454, 2,000,830; 2,548,056, 3,170,451 and 3,357,418. Apparently none of these have been satisfactory enough to meet with commercial success. Moreover, none of the references have indicated any voltages higher than the normal operating voltages of 6–12 volts. Furthermore, some of these prior art devices use a vibrator employing 115 cycles, which is capable of attaining a maximum of no more than about 12,000 volts.

SUMMARY OF THE INVENTION

In accordance with the present invention, an emergency portable device has been discovered which is much more successful than prior art devices in starting and operating stalled internal combustion engines. This device has a solid state integrated circuit or timing device designed to produce a square wave of electrical impulse; a transistor which amplifies the square wave into a coil; a coil having primary and secondary windings capable of transforming the square wave into approximately 60,000 or more volts; a reverse polarity diode; a switch to turn on the unit; a switch, preferably a two-pole switch of a pushbutton type to engage the starting solenoid, two leads to connect the solid state integrated circuit to the negative and positive terminals of the battery and a high voltage lead that connects the unit to the distributor cap of the engine.

The combination of the solid state integrated circuit and the power transistor is capable of generating voltages of about 60,000 volts or higher and thereby gives the unit a more reliable and hotter spark. A starter button or switch is connected to the solid state integrated circuit so that when the switch is in one position, such as when the button is pushed in, a resistor is shunted out of circuit with the solid state integrated circuit and the latter will thereby generate its full voltage of 50,000–80,000, preferably about 60,000 volts. Then when the button is released or the switch put in its other position, this resistor is put into circuit with the solid state integrated circuit and the voltage generated is thereby reduced to 20,000–40,000, preferably about 30,000 volts. The pushbutton or switch used for this purpose is preferably double-poled to simplify shunting out the resistor for the starting period when the maximum voltage is preferred.

When the disabled engine is connected to the emergency device of this invention as described herein, the on-off switch is turned on to energize the unit and then a button is pushed which enables the combination of the solid state integrated circuit and the transistor to generate preferably 60,000 volts or more, which is delivered to the distributor head and therefrom to the sparkplugs. Once the engine is started the button is released which allows a resistor to reduce the generated voltage to approximately 30,000 volts at which voltage engine operation is continued.

In addition to the use of much higher voltages and other improvements over the prior art devices, the device of this invention is adaptable to be used with a "High Energy Ignition" system adopted recently in General Motors cars in which the coil is the car's distributor cap. By use of an adapter as described herein, the coil in the unit of this invention is cut out of circuit and the coil in the distributor head is employed instead.

To facilitate description of the invention, reference is made to the drawings in which.

Figures 1, 2, 3, 4, 5:
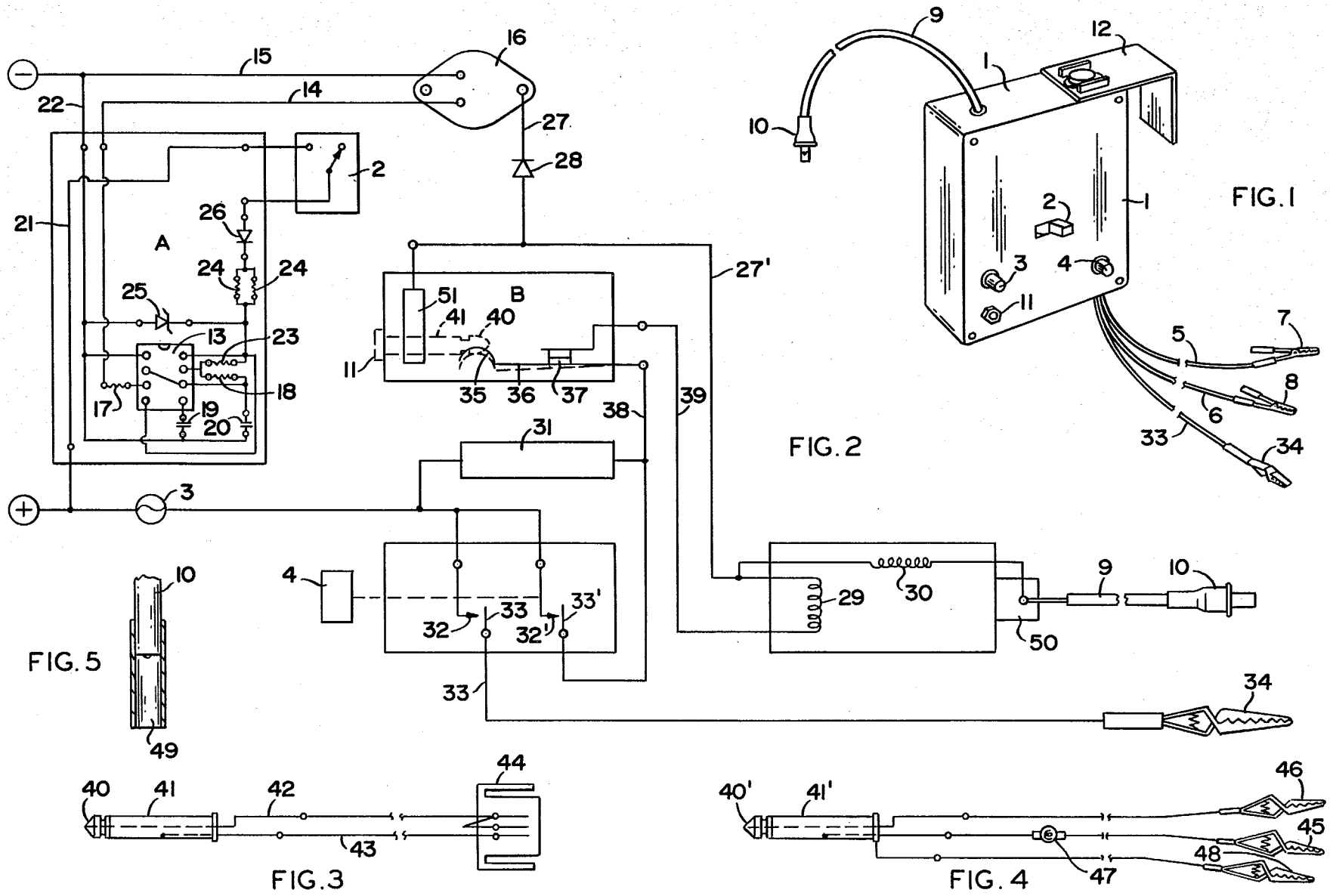
FIG. 1 is a pictorial view of a typical unit of this invention.
FIG. 2 is a schematic circuit diagram of the embodiments of FIG. 1.
FIG. 3 is a front elevational view of an adapter for use with an engine having its coil in the distributor head.
FIG. 4 is a front elevational view of an adapter for testing an automobile coil.
FIG. 5 is a cross-sectional view of an adapter designed to fit into a male type of distributor socket.

In FIG. 1, outer casing or housing 1 covers the integral parts of a typical modification of this invention. Switch 2 is used to put the unit into service. Fuse 3 is accessible from outside the housing. Switch or button 4 is used to start the engine by inducing the application of extremely high voltage to the distributor (not shown). Leads 5 and 6 have terminal clips 7 and 8 for connection to the positive and negative terminals of the battery (not shown). Lead 33 has terminal clip 34 for clipping to the starter solenoid. High voltage lead 9 has a terminal plug 10 for insertion into the distributor head. Socket 11 is provided for insertion of the adapters shown in FIGS. 3 and 4. Bracket 12 is provided for resting the unit on an appropriate support.

FIG. 2 shows the circuitry for the various integral parts of the unit. Rectangle A embraces the solid state integrated circuit 13 which is connected by lead wires 14 and 15 to transistor 16 having the indicated resistors 17 and 18 and capacitors 19 and 20 in the circuit as indicated. The solid state integrated circuit 13 is also connected to the battery terminals by lead wires 21 and 22 with switch 2, resistors 23 and 24 and protecting diodes 25 and 26 positioned in the circuit as shown. Diode 25 protects the solid state integrated circuit against high voltage, that voltage above the normal input voltage of about 7.5 volts. The diode cuts any over-voltage down to about 7.5. Diode 26 protects against reverse polarity. Power transistor 16 is connected by lead wire 27 through protecting diode 28 to terminals of the primary winding 29 and secondary winding 30 of the coil D. Diode 28 protects the transistor against back high voltages or spikes. The other terminal of the primary winding 29 is connected through the circuitry of jack B and resistor 31 to the positive terminal of the battery. When button 4 is pushed in, the contact 32' comes into contact with lead 33 to shunt across resistor 31 and thereby allows the maximum voltage to be applied through leads 38 and 29 to the primary winding. When the pushbutton is released, the shunt is disconnected and the resistor reduces the voltage to about half of the maximum. When the button 4 is pushed a second contact 32 connects with lead 33 to clip 34 which is fastened to the starter solenoid or to a lead wire leading to the solenoid.

In the jack circuitry B, conductive spring 35 keeps lead 36 in contact with connection 37 so that the circuit is completed between leads 38 and 39. When an adapter (either that shown in FIG. 3 or in FIG. 4) is inserted in socket 11, the lead 36 is separated from contact with connector 37, thereby breaking the circuit to coil D, and contact between 35 and 40 completes the circuit through lead 38, while 41 completes circuit through holder 51 and lead 27.

When the adapter shown in FIG. 3 is inserted in the socket 11, contacts 40 and 41 bring into the circuit an appropriate modification that feeds the power to operate the so-called "high energy ignition" (HEI) which is installed in the distributor heads of recent General Motors cars. Lead wires connect with the female connector 44 which fits the male plug on the HEI distributor cap.

When the adapter shown in FIG. 4 is inserted in the socket 11 and clip 45 (leading to bulb 47) is attached to the center of the spark coil tower, clip 46 is attached to the negative side of the coil and clip 48 is attached to the positive side of the coil, the automobile coil may be tested without the engine running and without taking the risk of sparks igniting gasoline fumes. If the coil is functioning properly, light 47 will go on.

The converter shown in FIG. 5 comprises female fitting 49 which fits over male plug 10 of FIG. 1 and also over the male plug on a Ford distributor cap.

In operating the unit of this invention, clip 7 is clipped to the negative battery terminal and clip 8 is clipped to the positive battery terminal. Clip 34 is attached to the starter solenoid of the disabled engine. With switch 2 in the "off" position, plug 10 is inserted into the appropriate socket of the distributor head of the engine. Switch 2 is turned to the "on" position to energize the unit and button 4 is depressed to generate about 60,000 volts which is applied by the distributor to the appropriate spark plugs. Once the engine is started, button 4 is released which acts to reduce the voltage to about 30,000 volts and the engine is operated under those conditions. Lead 9 and plug 10 are well insulated and for safety, switch 2 is in the "off" position while the plug 10 is being inserted. The device is properly insulated within the housing to avoid short circuiting.

In a preferred embodiment, the solid state integrated circuit may be a commercially available NE 555 timer (produced by Motorola, Fairchild and others). This is a standard IC integrated circuit chip having 21 transistors incorporated and has a timing control which gives a short spark.

The power transistor 16 is advantageously a Darlington circuit comprising two transistors operating alternately. Other transistors of equal reliability and performance may be used. Resistors 17 and 23 each advantageously may be of 180 kiloohms. Resistors 18 may be of 100 ohms and the resistance of resistors 24 may be a total of 82 ohms. Capacitors 19 and 20 may be of 0.01 microfarads ±10% and up to 100 volts. The primary winding 29 advantageously has 55 turns of #22 wire and secondary winding 30 advantageously has 19,000–21,000 turns of #31 wire. Inductor bar 50 may be of standard type, preferably with a hole drilled into the end of the bar so the connecting wires may be more securely soldered thereto.

In some cases the use of approximately 30,000 volts may be sufficient to start the car, in which case merely turning on the energizer switch may be sufficient. However, in many cases this lower voltage is not sufficient and it is necessary to push the button and generate the higher voltage which is much more capable of starting the car.

An advantage of the circuit of this invention is the fact that even when the battery is low this unit will operate, for example, at 6–7 volts instead of the normal 8 volts.

The circuit of this invention produces a shorter spark which enables the rotor to come into closer contact in the cap, which gives the engine better timing, better performance and less chance of overheating the car with incorrect timing. With vibrator devices of the prior art, inaccurate timing frequently causes overheating and makes it difficult to operate the car for any substantial period.

If desired, the prewired units may be embedded in a layer of tar or epoxy or other non-conductive protective material. Also, if desired, instead of bracket 12, magnets may be attached to the bottom of the housing so that the unit may be held to a metal surface while in use.

Accordingly a new and improved emergency ignition unit is provided which may be used for starting various types of internal combustion engines. The unit is portable and compact and may be stored indefinitely, always ready for immediate use in an emergency. The unit is also suitable for similar emergency operation of a vehicle on the road.

The solid state integrated circuit NE355 is described as timing circuit Mc1555/MC1455 on pages 8–298 and 8–299 of Volume 6 of "Linear Integrated Circuits—Series A"—Semi-conducts Data Library published in 1975 by Motorola Semiconducted Products, Inc.

While certain features of this invention have been described in detail with respect to various embodiments thereof, it will, of course, be apparent that other modifications can be made within the spirit and scope of this invention, and it is not intended to limit the invention to the exact details shown above except insofar as they are defined in the following claims:

The invention claimed is:

1. An emergency ignition device for operating the ignition system of an internal combustion engine of a vehicle having a battery, an ignition coil, an ignition switch, a starter solenoid and a distributor, said device operating independently of said ignition switch and comprising:

(1) a housing means;

(2) a spark coil located within said housing having primary and secondary windings;

(3) an on-off emergency switch;

(4) a double-pole, two-position starter switch or button extending beyond said housing;

(5) at least four flexible leads extending from said housing comprising:

(a) a first lead for connection of starter switch or button to said starter solenoid, (b) a second lead for connection of solid state integrated circuit and button switch to the positive terminal of said battery, (c) a third lead for connection of the circuit to ground, and (d) a fourth lead for connection of the spark coil to said distributor;

(6) a transistor;

(7) a solid-state integrated circuit capable of generating in combination with said transistor a voltage of at least 60,000 volts; and (8) a resistor positioned so that when said starter button is in one position this resistor is shunted out of direct circuit with said solid-state integrated circuit thereby permitting generation of high voltage of at least 45,000–75,000 volts and when said starter button is released or put in the other position said resistor is connected in direct circuit with said solid-state integrated circuit so that the generated voltage is reduced to 20,000–35,000 volts.

2. The device of claim 1 in which said high voltage is approximately 60,000 volts.

3. The device of claim 2 in which said reduced voltage is approximately 30,000 volts.

4. The device of claim 1 in which said reduced voltage is approximately 30,000 volts.

5. The device of claim 1 in which the unit is adapted by insertion of an adapter into the unit to cut out of circuit the coil of this unit and to employ instead the coil usually used for said engine.

6. The device of claim 5 in which said engine coil is located in the distributor cap of the engine.

* * * * *

UNITED STATES PATENT AND TRADEMARK OFFICE

CERTIFICATE OF CORRECTION

PATENT NO. : 4,207,851

DATED : June 17, 1980

INVENTOR(S) : Charles J. Crisefi

It is certified that error appears in the above—identified patent and that said Letters Patent is hereby corrected as shown below:

Col. 4, line 31, correct "NE355" to read ---NE555---

Signed and Sealed this

*Thirtieth* Day of *September 1980*

[SEAL]

*Attest:*

SIDNEY A. DIAMOND

*Attesting Officer*

*Commissioner of Patents and Trademark*